United States Patent [19]

Roth

[11] Patent Number: 4,893,747

[45] Date of Patent: Jan. 16, 1990

[54] ROTATABLE MAILBOX

[76] Inventor: Alfred C. Roth, 2388 Yost Blvd., Ann Arbor, Mich. 48104

[21] Appl. No.: 382,814

[22] Filed: Jul. 19, 1989

[51] Int. Cl.[4] ..... B65D 91/00

[52] U.S. Cl. ..... 232/39; 248/131

[58] Field of Search ..... 232/39, 17; 248/131, 248/415, 417, 418

[56] References Cited

U.S. PATENT DOCUMENTS

| | | | |
|---|---|---|---|
| 877,006 | 1/1908 | Scobee | 248/131 X |
| 1,240,190 | 9/1917 | Forth | 248/131 |
| 1,565,144 | 12/1925 | Harrell | 248/131 |
| 1,616,432 | 2/1927 | Aarseth | 248/131 |
| 1,696,530 | 12/1928 | Duncan | 248/131 |
| 2,552,915 | 5/1951 | Zachrich | 232/39 X |
| 4,213,560 | 7/1980 | Hall | 248/131 X |
| 4,363,460 | 12/1982 | Carroll | 248/415 |

*Primary Examiner*—Robert W. Gibson, Jr.

*Attorney, Agent, or Firm*—Dykema Gossett

[57] ABSTRACT

A rotatable mailbox support assembly for mounting a mailbox such that it can be rotated from a first position to a second position. The assembly has a base member which is adapted to be mounted to a vertical support post or to an outwardly extending arm. A rotatable support plate is rotatably mounted with respect to the base member such that a mailbox mounted to the support plate can be rotated with respect to the base member and support means. The rotatable support plate is journaled to the base member by a spindle which is concealed from the elements. A latch is attached to the base member and controls the position of the mailbox and permits manual release of the mailbox for rotation. An auxiliary arm is provided which can be used with the rotatable mounting assembly for mounting the assembly to a square or round vertical post. Additionally, an adapter is provided for replacing the standard wood block used in mounting a standard mailbox.

8 Claims, 2 Drawing Sheets

ROTATABLE MAILBOX

The present invention is directed to an improved mailbox and more particularly to a mounting apparatus which permits the mailbox to be moved from its normal position to a position where mail can be safely removed from the mailbox.

Typically, mailboxes are mounted in a fixed position with their openings facing the street. This permits the mail carrier to drive up to the box and insert mail without leaving the delivery vehicle. The problem with this arrangement is that the homeowner is exposed to passing traffic when retrieving mail. This problem is particularly acute in rural areas because of the types of roadways and the lack of lighting.

Attempts have been made to overcome this problem and some of these attempts have included various types of rotatable mailboxes. Examples of rotatable mailboxes can be found in U.S. Pat. Nos. 1,411,867 issued to Munson; 3,272,465 issued to Baarsgard; 3,407,997 issued to Wood, et al.; 3,827,626 issued to Daigle and 4,667,918 issued to Page. Each of these mailboxes illustrate an attempt to provide a mailbox that can be rotated from a position facing the roadway to a position where mail can be safely retrieved, but each has substantial drawbacks making it impractical for use.

The patents of Munson, Baarsgard, Daigle and Page all suffer from a common disadvantage. Each requires a special post for mounting the mailbox. None of the mailboxes can be used on standard posts commonly used to support mailboxes. Further, none of the disclosed mailboxes can be used on a mailbox support which includes an arm extending perpendicular to a vertical support post. Each requires mounting to the top of a post as opposed to mounting on a support arm. Support arms are quite common in rural areas to extend the mailbox out into the roadway so it is easily accessible by mail personnel.

In addition to the above, Munson has a further disadvantage in that the mailbox is supported upon an arm 10 which is journaled to a support post 12 and held in a normal position by opposed springs 18. The collar 20 at the end of arm 10 would require continued maintenance to ensure that it freely journals upon post 20. Further, the coil springs 18 would also have to be frequently maintained to ensure their proper operation. Lastly, the unit appears to be extremely unstable and provides its own safety problem because the mailbox will swing back and forth through several cycles before coming to rest due to the resiliency of the springs.

Baarsgard has a further disadvantage in that it is an extremely complicated structure which would not be economical to manufacturer. Further, it would require continued maintenance due to the exposed linkages and collars 28 and 44 which permit journaling of the mailbox on post 18.

Daigle also provides a complicated multi-linkage mailbox which would require continued maintenance because of exposed linkages. The rotation mechanism of this unit is better protected from the elements than the previous units. In this unit, a stud 8 is affixed to the bottom of the mailbox frame and extends into a post section 9 having a tubular head section. Rotation is controlled by a pin and linkage system which is received within apertures formed in the head portion of section 9. Although this is an advantage over the previous units, this unit still has the disadvantage of multiple linkages and exposure of those linkages to the elements.

Wood, et al. illustrates a unit which has a rotational mechanism that is concealed from the elements. However, the mechanism is extremely complicated and would appear to be extremely expensive to manufacturer. Further, the rotation mechanism or support 20 has a small base which is screwed or nailed to the top of a post making it inherently weak or unstable.

Page also suffers from high manufacturing costs. It employs a somewhat concealed rotational mechanism; however, as seen in FIG. 4, when the mailbox is rotated, the interior of the post and the rotational mechanisms are exposed. Further, the use of a key lock system is impractical because the mail person and home owner would have to use a key to unlock the unit to rotate it.

SUMMARY OF THE INVENTION

The present invention overcomes the above-disadvantages by providing a versatile, economical, easily manufactured and easily maintained rotatable mailbox assembly. The assembly will support all sizes and various models of mailboxes and can be easily mounted on all common mailbox supports, such as, for example, square and round vertical posts and posts having outwardly extending arms. The unit has only two movable parts, the rotatable plate to which the mailbox is attached and the latch mechanism. These parts are well protected from the elements and the assembly is virtually maintenance free. Further, the unit is extremely easy to operate requiring only the release of the mechanism to permit rotation of the mailbox.

Briefly, the rotatable mailbox comprises a base member having a top plate and downwardly extending side members which define a generally U-shaped channel. This base member has several mounting means for mounting the unit on the top of a vertical post or an arm extending outwardly from the post.

A rotatable support plate is rotatably mounted to the base member for free rotation with respect to the base member. A standard mailbox can be mounted to this support plate so that the mailbox assembly is free to rotate. In the preferred embodiment, a subplate is first mounted to the base member. The subplate and the support plate are parallel and spaced apart with the support plate rotating with respect to the subplate. Spacers are used to separate the support plate from the subplate.

The support plate is rotatably connected to the base member by a pin or spindle which extends downwardly from the support plate. The pin is journaled in holes formed in the subplate and the base member and is held in place by a lock washer or other locking means.

A latch is mounted on the side of the base member and is selectively engagable with the support plate. The latch includes a housing which is mounted, for example by spot welding, to the base member and a spring loaded pin which is reciprocally received within the housing. A knob protrudes from the pin and housing permitting manual operation of the pin for releasing the support plate.

An auxiliary mounting member is also disclosed for use in conjunction with the mailbox assembly. The auxiliary mounting member has a mounting bracket and an arm extending outwardly from this bracket. The bracket is adapted for mounting to a vertical support having a flat or round surface and the arm is adapted for receipt of the base member of the support assembly.

Further, there is an adapter included for mounting a standard mailbox to the rotatable support plate. This adapter replaces the block of wood usually used in the base of a mailbox to mount the mailbox to a support. The adapter has a base plate and opposed side members. The side members have slots for receipt of mounting means to affix the mailbox to the adapter. In a preferred embodiment, plastic drive pins are used to secure the mailbox to the adapter. The base plate receives fastening means to affix the adapter and mailbox combination to the support plate. Apertures can be preformed in the adapter to align with preformed holes in the support plate.

DETAILED DESCRIPTION OF THE INVENTION

Figure 1:
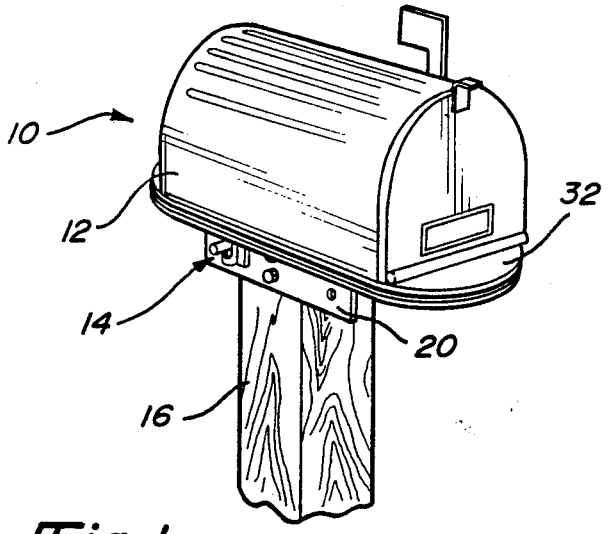
FIG. 1 is a perspective view of the rotatable mailbox of the present invention in a first position.
Figure 2:
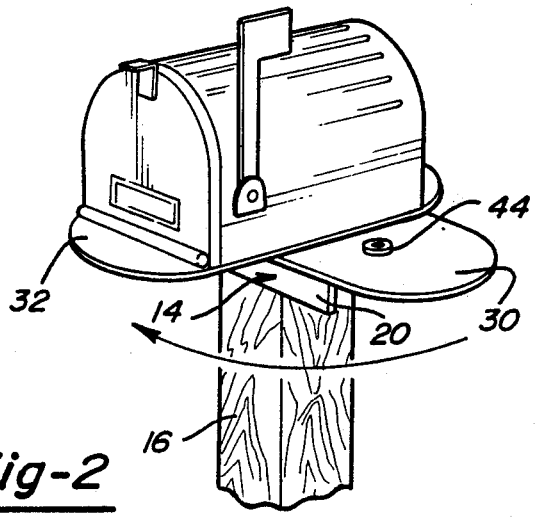
FIG. 2 is a perspective view similar to FIG. 1 with the rotatble mailbox of the present invention rotated through 90°.
Figure 3:
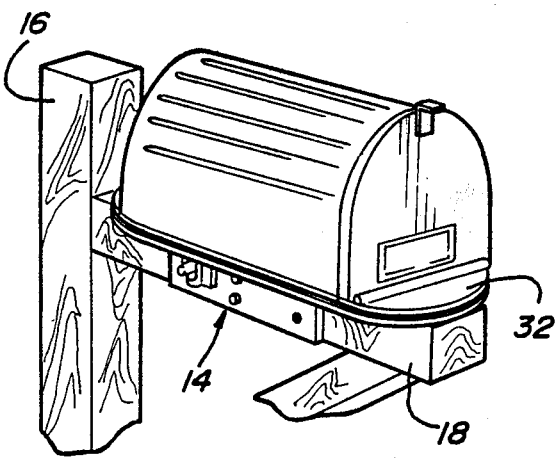
FIG. 3 is a perspective view of the rotatable mailbox mounted on an outwardly protruding arm.

With reference to FIGS. 1–3, the rotatable mailbox of the present invention is shown generally at 10. The mailbox 12 used in the illustration is a standard mailbox. It should be apparent, that various models of mailboxes can be used. The mailbox 12 is mounted to a rotatable support assembly 14 which permits rotation of the mailbox with respect to the mounting post 16. In FIGS. 1 and 2, the mailbox 12 is shown rotated from its normal position which would be facing the roadway to a second position wherein a recipient can retrieve mail without entering the roadway. The post in FIGS. 1 and 2 is a standard vertical mailbox support post with the mailbox mounted on the top of the post. With reference to FIG. 3, a second example of the versatile mounting of the support assembly 14 is illustrated. In this embodiment, the support assembly is mounted to a support arm 18 which extends outwardly from post 16. As will be understood by those of ordinary skill in the art, these are the standard ways of mounting mailboxes.

Figure 4:
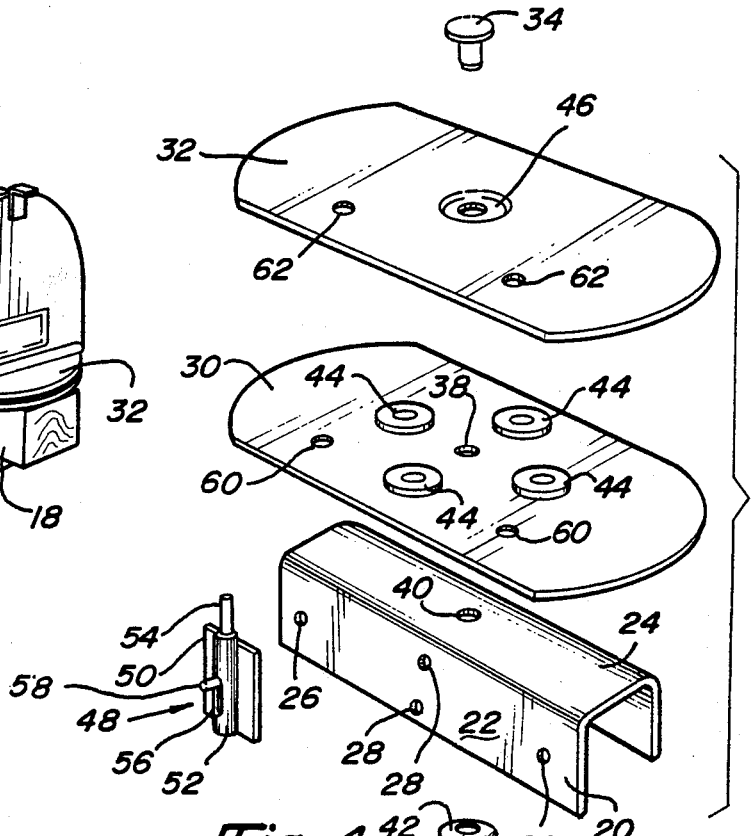
FIG. 4 is an exploded view of the rotatable mailbox support means of the present invention.
Figure 5:
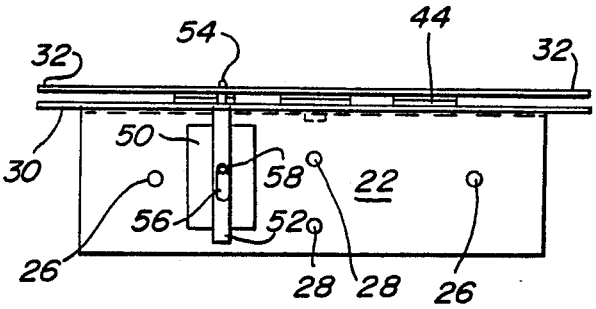
FIG. 5 is a side view of the rotatable mailbox assembly of the present invention.

With reference to FIGS. 4 and 5, the support assembly 14 will be described in detail. The support assembly includes a base member 20 which is U-shaped having sides 22 and a top plate 24. This U-shaped base member is configured to fit over a standard post or arm used to support a mailbox. Apertures 26 and 28 are formed in sides 22 for fastening the base member to the support post or arm. Apertures 28 are used if the support assembly 14 is mounted to the top of a post and apertures 26 are used if the base member 20 is mounted to an arm on a support post. Bolts or wood screws can be used to fasten the base member 20 to the post.

In the preferred embodiment, a subplate 30 is fastened to the top plate 24 of member 20. Subplate 30 can be spot welded to top plate 24; however, other means of fastening subplate 30 are available. A rotatable support plate 32 is spaced from subplate 30 and maintained substantially parallel thereto. A spindle 34 protrudes from plate 32 and is journaled within apertures 38 and 40 in subplate 30 and top plate 24 respectively. Spindle 34 is retained within apertures 38 and 40 by a lock washer 42 which is pressed over the free end of spindle 34. Spacers 44 are positioned between plate 32 and subplate 30 to maintain proper spacing and to facilitate rotation. In the disclosed embodiment, a recess 46 is provided in support plate 32 to recess head of spindle flush with top surface of support plate 32.

Mounted to the side of base member 20 is a latch mechanism 48 which locks support plate 32 from rotation. Latch mechanism 48 includes a mounting bracket 50 which is connected, as for example, by spot welding to the side 22 of member 20. A housing 52 is connected to or formed integrally with mounting bracket 50 and houses a spring loaded latch pin 54 which is free to reciprocate within housing 52. Housing 52 has a slot 56 in its side from which a knob 58 protrudes for manual reciprocation of pin 54. When fully extended, the free end of pin 54 is received within an aperture 60 in subplate 30 and one of the apertures 62 in support plate 32.

In operation, the free end of pin 54 is normally spring biased into aperture 62 to lock the mailbox in its normal position. Once mail is delivered, knob 58 can be pressed downwardly to release pin 54 from aperture 62 so that the mailbox 12 can be rotated to a second position to remove the mail. The box can be locked in this second position by releasing the knob 58 so that the spring loaded pin 54 is received within the second aperture 62 in plate 32. As should be apparent, the position of the mailbox can be rotated through 360° and the apertures 62 can be positioned to permit the mailbox to be locked in any angular position. The illustrated apertures 62 are preferred so that the mailbox can be located at two positions at right angles to each other, permitting straight forward and perpendicular positioning.

Figure 6:
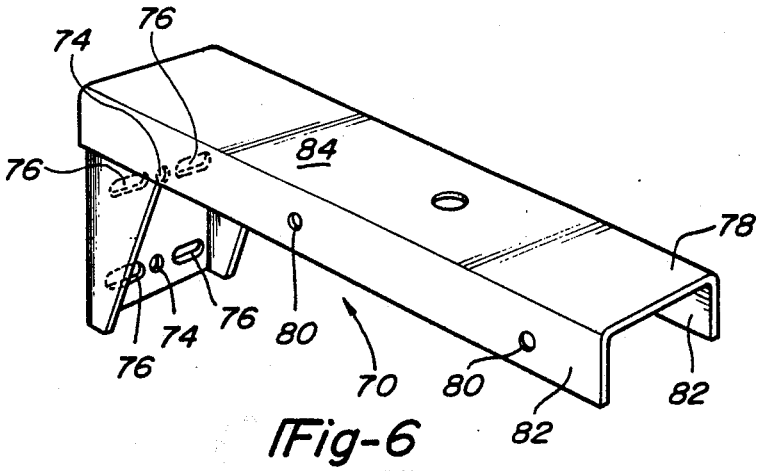
FIG. 6 is a perspective view of an adapter adapted for use with the rotatable mailbox of the present invention to provide an outwardly extending arm onto which the rotatable mailbox can be mounted.

Referring now to FIG. 6, the assembly also includes an optional support arm bracket 70. This bracket can be used in the same manner as arm 18 shown in FIG. 3. The support arm bracket 70 has a rear mounting bracket 72 with two sets of apertures 74 and 76 for versatile mounting applications. Apertures 74 are used to mount the rear mounting bracket 72 to a flat surface such as, for example, a standard post as shown in FIG. 1. Apertures 76 are adapted to receive a U-bolt so that the support arm 70 can be mounted to a circular surface such as, for example, a round post. Extending outwardly from rear mounting bracket 72 is a support arm 78. The support arm has sides 82 interconnected by a top plate 84. Apertures 80 are provided in sides 82 and are preferably aligned with apertures 26 in base member 20 for receipt of fastening means to fasten member 20 to arm 78.

Figure 7:
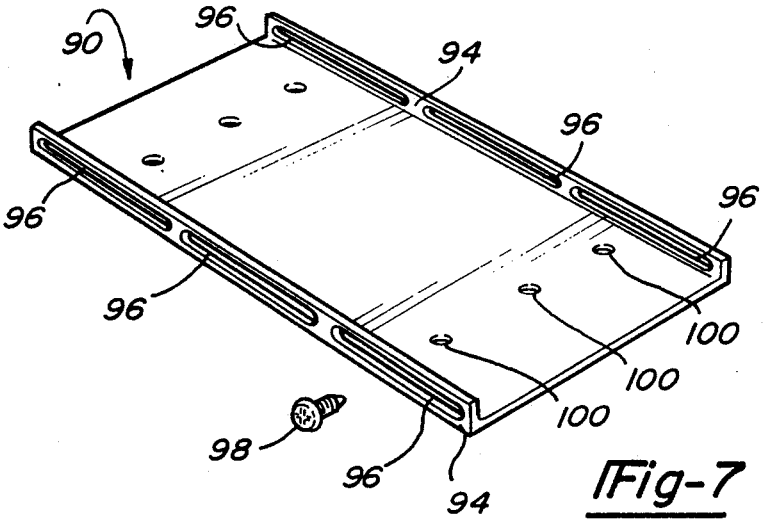
FIG. 7 is an auxiliary mounting base member for use with the rotatable mailbox of the present invention.

With reference now to FIG. 7, an adapter unit 90 will be discussed. This adapter unit is designed to replace the conventional wood block used in mounting a conventional mailbox 12. Normally, a wood block is cut and placed in the recessed area at the base of the mailbox for receipt of the fastening means used to fasten the base to the mailbox support. The adapter unit 90 takes the place of this wood block. Preferably, it is made of plastic material and has a base 92 with upstanding side members 94. Slots 96 are formed in the side members 94 for receipt of plastic drive locks 98. These drive locks can be driven into the holes in the side of a standard mailbox and locked into the slots to secure the adapter unit 90 to the mailbox. Apertures 100 are provided in base 92 and are preferably aligned with apertures 102 in the rotatable plate 32 for mounting the mailbox 12 to support plate 32.

While the preferred embodiment of the present invention has been described so as to enable one skilled in the art to practice the techniques of the present invention, the proceeding description is intended to be exemplary and should not be used to limit the scope of the invention. The scope of the invention should be determined only by reference to the following claims.

What is claimed is:

1. A rotatable mailbox support means comprising:

a base member having a top plate and downwardly extending side members defining a generally U-shaped channel, said base member having mounting means for mounting said base member to a support member;

a support plate rotatably mounted to said base member substantially parallel thereto such that said support plate can rotate with respect to said base member;

a rotational means interconnecting said base member and said support plate permitting rotation of said support plate with respect to said base member;

a control means interconnected to said support plate operably controlling the rotation of said support plate;

whereby said control means can be operated to release said support plate and permit rotation of said support plate with respect to said base member and to lock said support plate in a fixed position with respect to said base member.

2. The rotatable mailbox support means of claim 1, wherein said mounting means includes an auxiliary mounting member having a mounting bracket and an arm extending outwardly from said mounting bracket;

said mounting bracket being adapted for mounting to said support member;

said arm being adapted for receipt of said base member.

3. The rotatable mailbox support means of claim 2, wherein said mounting bracket includes two sets of apertures, one set of apertures being adapted for mounting said auxiliary mounting member to a flat support surface and said second set of apertures being adapted for mounting said auxiliary mounting member to a round support surface.

4. The rotatable mailbox support assembly of claim 1, further including an adapter mount for mounting on the bottom of a mailbox, said adapter having a base plate and opposed side members, said side members having apertures therein for receipt of fastening means to affix said adapter to said mailbox;

said adapter base plate receiving fastening means to fix said adapter and mailbox combination to said support plate.

5. The rotatable mailbox support means of claim 4, wherein said adapter is made from plastic material.

6. The rotatable mailbox support means of claim 1, wherein said base member includes a plurality of holes for mounting said base member to said support member, said holes being positioned such that said base member can be mounted to a support member comprising a single vertical post or to a support member including a substantially perpendicular mounting arm.

7. The rotatable mailbox support means of claim 1, wherein said control means includes a manually operated latch mounted to said base member and selectively engagable with said support plate to lock and unlock said support plate.

8. The rotatable mailbox support means of claim 7, wherein said latch includes a housing mounted to said base member and a spring loaded pin movably mounted in said housing;

said pin having a knob thereon protruding outwardly from said housing perpendicular to said pin such that said pin can be manually reciprocated within said housing.

* * * * *